US006230478B1

(12) United States Patent
White

(10) Patent No.: US 6,230,478 B1
(45) Date of Patent: May 15, 2001

(54) DIFFERENTIAL LENGTH METERING APPARATUS AND METHOD FOR THE CABLING OF INSULATED CONDUCTORS WITH FILLERS USING THE DOUBLE TWIST PROCESS

(75) Inventor: Paul White, Newmarket (CA)

(73) Assignee: Nextrom Ltd., Concord (CA)

( * ) Notice: Subject to any disclaimer, the term of this patent is extended or adjusted under 35 U.S.C. 154(b) by 0 days.

(21) Appl. No.: 09/452,360

(22) Filed: Dec. 1, 1999

(51) Int. Cl.[7] ..... D01H 1/10

(52) U.S. Cl. ..... 57/58.49; 57/58.52; 57/58.7; 226/24; 226/124; 226/127; 226/128; 226/129; 226/196.1; 492/28; 492/30; 492/36; 492/39

(58) Field of Search ..... 57/58.49, 58.52, 57/58.7; 226/24, 124, 127, 128, 129, 196.1; 492/28, 30, 36, 39

(56) References Cited

U.S. PATENT DOCUMENTS 3,732,682 * 5/1973 Crotty et al. ..... 57/59
4,574,571 * 3/1986 Thompson ..... 57/3

* cited by examiner

*Primary Examiner*—John J. Calvert
*Assistant Examiner*—Shaun R Hurley
(74) *Attorney, Agent, or Firm*—Lackenbach Siegel Marzullo Aronson & Greenspan, P.C.

(57) ABSTRACT

Apparatus and method for manufacturing helically wound insulated conductors with filament fillers includes first and second payoff stations for paying off a plurality of insulated conductors and elongate filaments of filler materials. These cable components are guided from the payoff stations to a closing die, and are arranged in positions suitable for twisting into a cable by a double twist machine to form a cable of twisted insulated components forming radially outwardly facing helical interstices each of which is substantially filled with another one of the filaments of filler material. Differential or incremental lengths of filler material are metered upstream of the double twist machine to compensate for the differences in the radial distances of the insulated conductors and filaments of filler material on the center or cable of the axis. In this way, the helical interstices are more fully filled and the resulting cable has an exterior surface with minimal voids so that covering of the resulting cable with an outer elastomeric jacket or coating results in a substantially smoother and aesthetically pleasing cable with minimal surface irregularities.

18 Claims, 3 Drawing Sheets

DIFFERENTIAL LENGTH METERING APPARATUS AND METHOD FOR THE CABLING OF INSULATED CONDUCTORS WITH FILLERS USING THE DOUBLE TWIST PROCESS

BACKGROUND OF THE INVENTION

1. Field of the Invention

The invention relates to wire machinery and, more specifically, to an apparatus for and method of differential length metering for the cabling of insulated conductors with fillers using the double twist process.

2. Description of the Prior Art

Machines, sometimes denominated as stranders, twisters, single and double twist twinners, quadders, single and double twist stranders, cablers and bunchers, have been in existence for many years. These machines are used to combine a plurality of individual wires and bunch or strand them together by imparting a single or double twist to them.

Typically, the individual strands or wires are payed off from a plurality of bobbins and directed at one input end of the machine or at both ends of the machine in the case of bunchers as described in U.S. patent application Ser. No. 602,667, assigned to the assignee of the subject application.

The wires are grouped or bunched together at the closing point prior to the entry into the machine. The closing point remains fixed relative to the main part of the machine.

The bunched wires or strands are then introduced into one end of a bow which rotates about the longitudinal axis of the machine. In the case of the double twist bunchers, it is the rotation of the bow that imparts a first twist to the wires at the input end of the bow while passing a first input pulley or sheave. Leaving the bow at the other end, the bunched and now single twisted wires pass over a second exit pulley or sheave which rotates with the bow. From this rotating sheave the bunched or stranded cable is directed over a sheave that is mounted on a cradle that is stationary in relation to the frame of the machine.

A second twist is imparted to the wire between the last sheave mounted on the bow and the sheave attached to the cradle. Additional pulleys disposed within the space defined by the rotating bow guide the now double twisted cable or wires to the bobbin supported within the stationary cradle and are wound on the bobbin itself while being evenly distributed thereon. Depending on the machine, slightly different wire guide systems have been used.

Double twist twinners, bunchers and closers have been extensively used in the electrical wire and cable, steel tire cord and steel rope industries for many years.

Typical machines are illustrated in the "Electrical Wire & Cable Machinery" catalog published by Ceeco Machinery Manufacturing Limited, the assignee of the subject application. Other exemplary structures of existing machines are disclosed in U.S. Pat. Nos. 3,570,234 and 3,732,682.

Machines for twisting a plurality of wires with the single twist system comprise a rotatable flyer and a reciprocally traversing reel rotatably supported within the flyer. A speed differential exists between the rotation of the flyer and the reel. A plurality of wires are fed from sources external to the machine, to the flyer for twisting the strands together. Due to the differential in rotation rates, the twisted strands are then wound from the flyer onto the reel.

In order to keep a constant lay, the rotation of the flyer and of the bobbin are controlled in such a way that a constant lay is maintained and a single twist is imparted to the individual wires fed through the flyer and onto the reel. Machines of this kind are described, for example, in U.S. Pat. Nos. 2,817,948 and 4,235,070.

The above machines are normally used to manufacture stranded or bunched conductors and to assemble two or more insulating conductors to form pairs, quads and other twisted conductors mainly used in the telephone communication industry.

Electrical cables, particularly those used in the telecommunications industry, are advantageously provided with one or more electrically conductive shields or screens which wrap around and enclose one or more groups of individual conductors. Such shields or screens help reduce pick-up of external electrical interferences, radiation and cross talk between adjacent conductors within the cable. The greater the conductivity of the shield or screen the better the results that are obtained. One form of shield or screen that is frequently used is a continuous tape coated at least on one side thereof with a conductive material. A metallized Mylar tape is commonly used. The tape can be helically wound or longitudinally applied about the conductor or conductors to be shielded or screened so that successive turns or lays of the tape overlap and make contact. For a tape made of a conductive material or a tape coated on both sides with a conductive material such overlapping contact provides the requisite conductivity of the shield. For tapes coated with a conductive material on one side only, the tape needs to be folded so that there is electrical continuity between successive turns or lays. In some instances a drain wire is wrapped on one or both sides of the tape shield to bridge successive turns and provide or enhance the required conductivity. Numerous cable designs have been proposed, each normally for a specific or particular purpose. Some examples of shielded cables which use tape to provide the shield or screen are described in the following U.S. Pat. Nos. 4,323,721; 4,327,246; and 4,406,914.

Taped conductors or assemblies have been traditionally made on single twist machines since the tape would be cracked or unacceptably stretched during the second twist imparted by a double twist machine.

Therefore, up to now the production of tape and/or screened products widely used in the telecommunication and specialty cable industries were made on slower machines. The same has been true for products with fillers as well.

The attempts to utilize double twist equipment was not successful because, as mentioned, the second twist imparted on the products at the end of the bow, would damage the taped conductor or assembly, thus producing cables of unacceptable quality.

Therefore, the state-of-the-art equipment can produce acceptable product only at slower speeds on single twist or equivalent machines.

In U.S. Pat. No. 4,574,571 an apparatus and method are described for manufacturing taped products with double twist equipment. This patent discloses the use of a pre-twister to meter in the correct amount of tape while taping using the double twist process. The disclosed apparatus works well for taped products. However, in some cables fillers are used in the production of insulated conductors in an effort to keep the outer surface of the cable as smooth or "round" as possible. The difficulty in producing these types of products using the double twist process results from the greater length of filler material required versus the length of conductor material required. This is due to the different cable centroid radii as suggested by $R_c$ and $R_f$ in FIG. 1. As a result, in a conventional double twist process, there is normally an inadequate amount of filler on the second twist. When stretched, the filler does not remain in the outer interstices but is drawn towards the center of the construction to thereby result in depressions in the outer surface of the cable instead of providing the desired smooth or "round" surface.

The use of a pre-twister alone to meter in the correct length of filler is not adequate, due to the integrity of construction (filler material is not rigid). The rotation of the product alone does not pull in the filler material.

The present invention, which overcomes this problem, consists of a metering wheel by which the conductors are wound one full wrap on the wheel in a groove of a specified diameter. The filler material is then wrapped on the same wheel but in a groove of a larger diameter. For each revolution of the wheel, more filler material is metered than conductor material, providing the extra length of filler material to avoid undue stretching when passed through a double twist machine. This results in a higher quality more uniform cable.

SUMMARY OF THE INVENTION

Accordingly, it is an object of the present invention to provide an apparatus and a method of cabling insulated conductors with fillers using the double twist process.

It is another object of the invention to provide an apparatus and method of cabling as aforementioned which can be used to produce high quality cables that provide a substantially smoother and aesthetically pleasing outer configuration with minimal surface irregularities.

It is still another object of the invention to provide a differential length metering apparatus and method as in the previous objects which utilizes a double twist machine for twisting individual insulated conductors rendering the manufacturing process and method more efficient and less costly.

It is yet another object of the invention to provide a differential length metering apparatus and method of cabling insulated conductors with fillers that exhibit less tensile strength than the insulated conductors but which are appropriately metered to provide a twisted cable having a substantially uniform circular cross section along its longitudinal length by compensating for the required lengths of the twisted components as a function of the relative centroids of the insulated conductors and the filaments of filler material relative to the central axis of the resulting cable.

It is a further object of the invention to provide a differential length metering apparatus and method of the type under discussion which uses a line of conventional components and one that can be readily and inexpensively assembled.

In order to achieve the above objects, as well as others which will become apparent hereinafter, an apparatus for manufacturing helically wound insulated conductors with fillers comprises a first payoff means for paying off a plurality of elongate insulated conductors. A second payoff means is provided for paying off a plurality of elongate filaments of filler materials having a tensile strength lower than the tensile strength of said insulated conductors. Closing means is provided for closing said insulated conductors and filaments of filler material downstream from said payoff means. Guide means guides said insulated conductors and filaments of filler material from said payoff means to said closing means and arranges said insulated conductors and filament materials in position for twisting into a cable. A double twist arranged downstream of said closing means is provided for helically twisting said plurality of insulated conductors and filaments of filler material into a cable formed of said twisted helical conductors, and defining an axis and radially outwardly facing helical interstices each substantially filled with another one of said filaments of filler material. Differential length metering means is provided between said payoff means and said double twist machine for paying off an incrementally greater length of filler materials relative to the length of insulated conductor to substantially compensate for the difference in the radial differences of said insulated conductors and filaments of filler material from said cable axis. In this matter said helical interstices are more fully filled, and the resulting cable has an exterior surface with minimal voids, so that covering of the resulting cable with an outer elastomeric jacket or coating results in a substantially smoother and aesthetically pleasing cable with minimal surface irregularities.

The present invention also contemplates the method of manufacturing helically wound insulated conductors with fillers and in accordance with another feature of the invention, the apparatus and method may be adjusted to modify the relative differential or incremental lengths metered of the insulated conductors and the fillers as a function of the centroids of the components of the cable in relation to the center of the wound cable.

BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF THE PREFERRED EMBODIMENTS

Figure 1:
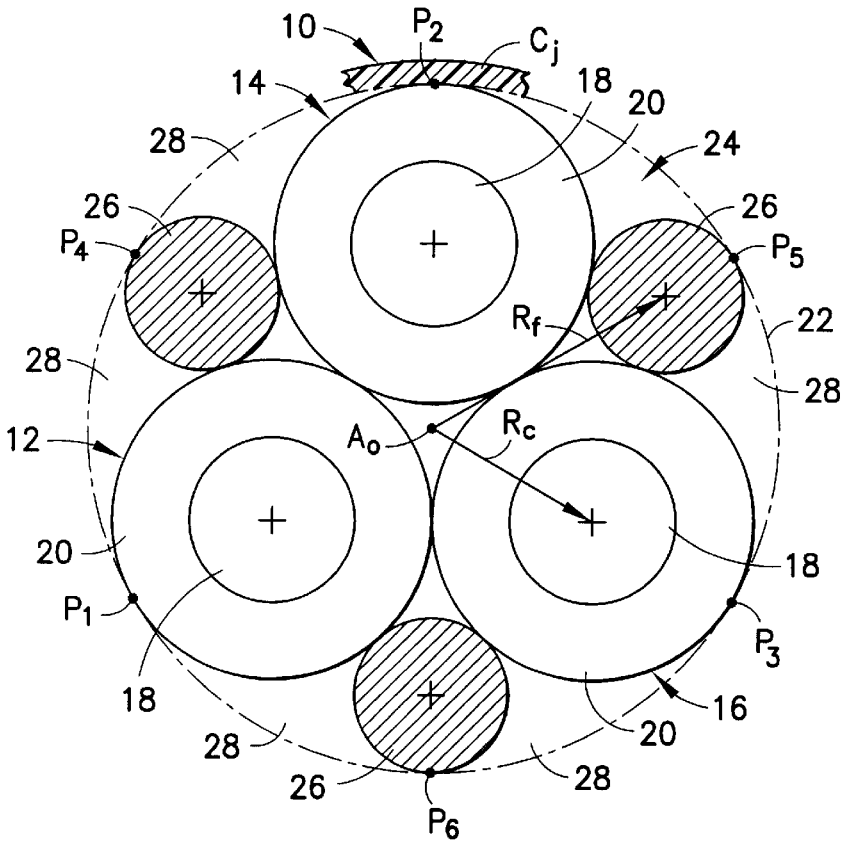
FIG. 1 is a diagrammatic cross sectional view of a twisted cable consisting of three insulated conductors forming three outwardly facing helical interstices each of which is filled with a filler material, as might be produced on a single twist machine or, in accordance with the present invention, also formed with the use of a double twist machine.

Referring now specifically to the Figures, in which identical or similar parts have been designated by the same reference numerals throughout, and first referring to FIG. 1, a cable in accordance with the present invention is generally designated by the reference numeral 10, and shown in cross section in FIG. 1.

The cable 10 is formed of three helically wound insulated conductors 12, 14, 16, each of which is formed of an elongate wire or conductor 18 covered by an insulative sheath or covering layer 20, typically of a polyethylene or PVC material. The elongate insulated conductors 12, 14, 16 are helically wound along the length direction of the cable and define a cable axis $A_0$. The radially outermost points $P_1$–$P_3$ define a cylindrical space which, in the cross section shown in FIG. 1, defines a circular envelope 22. Between the radially outermost points $P_1$–$P_3$, there are formed between adjacent insulated conductors pronounced helical intersticial spaces 24. When an outer covering jacket or sheath $C_j$ is applied to the twisted conductors it can exhibit significant surface irregularities as such covering jacket or sheath is supported at the point $P_1$–$P_3$, but finds no support in the regions of the interstitial spaces and therefore can collapse into or be drawn into those spaces. In order to enhance the appearance of the twisted cable, filler materials have been used to introduce such materials into the interstitial spaces 24 to prevent or at least minimize the deformations in the jacket or sheath $C_j$ in the regions of the interstitial spaces. Such filler materials could be strips of paper or polypropylene. They can be fed from a cop or rolled off a reel, depending on how they are supplied.

In FIG. 1, such filaments of filler material are indicated by the reference numeral 26, one such filament being introduced into each interstitial space 24 so as to promote the "roundness" of the finished product by providing points $P_4$–$P_6$ about the circumference of the cable which provide additional points of support along and about the circle 22. In the example shown, therefore, the number of points available for supporting the jacket or sheath $C_j$ about the circle 22 has been doubled from 3 to 6. As noted in the "Background," however, to produce a cable having the appearance or physical properties shown in FIG. 1 has been difficult to achieve at high speeds using double twist equipment. Because the filaments of filler material have a tensile strength less than the tensile strength of the insulated conductors, the extra twist imparted by the double twist equipment tends to stretch the filaments of filler material when equal lengths of insulated conductors and filaments of filler material are introduced into the double twist equipment. The extra stretching causes the filaments of filler material to be drawn inwardly towards the axis $A_0$ so that such filaments no longer provide the support at points $P_4$–$P_6$, causing a deterioration in the aesthetic appearance of the finished cable. For this reason, cables of this type have been manufactured using single twist equipment where excessive stretching is not exhibited when equal lengths of insulated conductors and filaments of filler material are metered to the twisting equipment. The additional stretching of the filaments or filler material can best be understood by reference to FIG. 1, from which it is clear that the centers or centroids of the insulated conductors and filaments or filler material are not the same—the centers of the insulated conductors being spaced a distance $R_c$ from the axis $A_0$, while the centroids or centers of the filaments of insulated material are spaced a distance $R_f$ from such cable center. In the illustrated example, $R_f > R_c$. Therefore, it will be clear that for a given length of cable, a greater length of filler material will be required as the helix formed by the filaments of filler material is larger than the helices formed by the insulated conductors. Therefore, when equal lengths of insulated conductors and filler material are metered and twisted into a construction as shown, the filaments or filler material are stretched during the second twist. Having a lower tensile strength, the filaments of filler material stretch and are drawn radially inwardly in order to effectively reduce the spacing of the centroid from the axis $A_0$ or effectively reduce the distance $R_f$ to substantially correspond to the distance $R_c$. However, when this occurs on a double twisting machine, the benefit for which the filler material is introduced is effectively lost. For this reason, twisted conductors with fillers of the type shown in FIG. 1 have, up to now, only been effectively and efficiently manufactured on single twist equipment.

Figure 2:
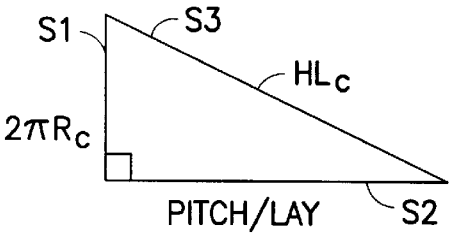
FIG. 2 is a mathematical representation illustrating the relationship between the pitch of the cable that results in a helical length of a conductor as a function of the radius of the centroid of the conductor in relation to the axis of the formed cable.
Figure 3:
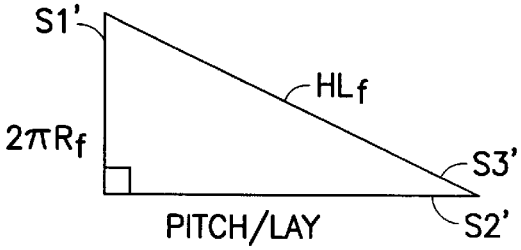
FIG. 3 is similar to FIG. 2 but illustrates the relationship between the helical length of the filament of a filler material in relation to the pitch of the cable and the centroid of the filler material in the helical interstices of the twisted insulated conductors in relation to the axis of the composite cable.

Referring to FIGS. 2 and 3, a mathematical approach is illustrated for computing and comparing the helical lengths of the insulated conductors and the filaments of filler material. In both Figures, the pitch or the lay of the cable S2, S2" are the same since both the uninsulated conductors as well as the filaments of filler material have the same lay along the twisted cable. However, in the case of the conductor, the side S1 equal to $2\cdot\pi(R_c)$, where $R_c$ is the radius or distance of the conductors from the center or axis $A_0$ of the cable while the corresponding side S1' equal to $2\cdot\pi(R_f)$, where $R_f$ is the distance of the center or centroid of the filament of filler material from the axis $A_0$. Once the two perpendicular sides are known, the hypotenuse S3 and S3' of each triangle can be computed. However, since the sides S2 and S2' are equal and $R_f > R_c$, it is equally clear that the side S3'>S3. For this reason, for the same pitch or lay for both components of the cable, a greater length of filler material must be provided in order to prevent stretching of the filaments of the filler material.

As long as additional filler material is metered in a quantity to compensate for the required differential between the two cable components, there should be no undue pulling or stretching of the filler materials, and the filler materials will fill the interstitial spaces 24 as shown in FIG. 1 while still projecting radially outwardly to make contact with the virtual circle 22 and, therefore, the covering jacket or sleeve $C_j$. In those instances where the differential in the radii or distances $R_f$ and $R_c$ are small, the additional amount of filamentary filler material need also be only small. The remaining interstitial spaces 28 may result in second order deformations or surface irregularities.

Figure 4:
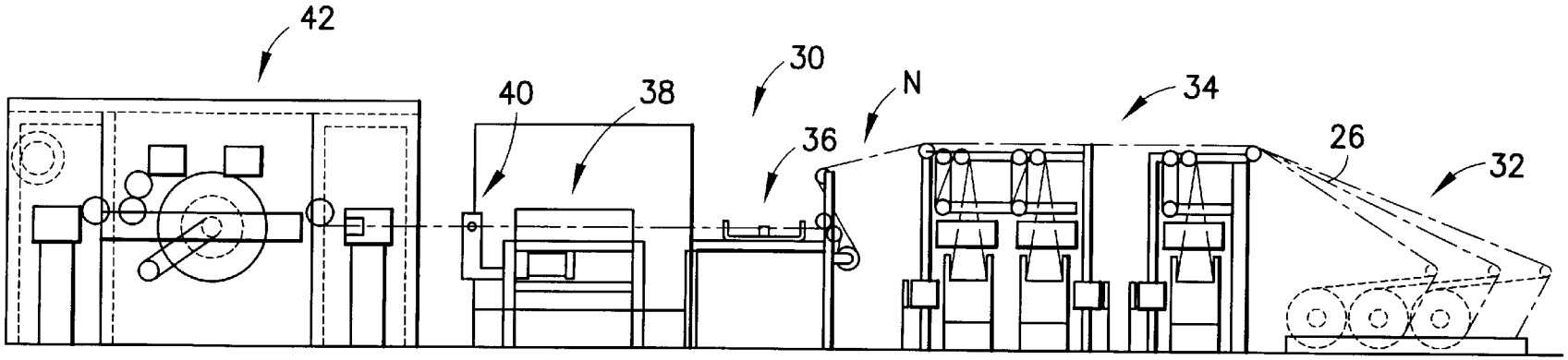
FIG. 4 is a side elevational view of an apparatus for providing differential length metering in the production of cabling of insulated conductors with fillers using the double twist process in accordance with the invention.

Referring to FIG. 4, the line or apparatus for producing twisted cables in accordance with the invention is similar to the line shown in U.S. Pat. No. 4,547,571. Thus, starting at the upstream end, a filler payoff station 32 provides a source of a plurality of filaments of filler material 26 which are guided, by suitable rollers or sheaves, to a conductor payoff station 34 which supplies a plurality of elongate insulated conductors 12, 14, 16. The filaments of filler material 26 are guided through or adjacent to the conductor payoff station 34 so that at the output of this station 34 a suitable number N of insulated conductors and filaments of filler material are provided required to produce the composite cable shown in FIG. 1. In the embodiment shown in FIG. 1, N=6.

In accordance with the invention, a length metering station 36 is provided at the downstream end of the conductor payoff station 34, which metering station will be more fully discussed in connection with FIGS. 5 and 6. However, the metering station 36 meters differential or incremental lengths of insulated conductors and filaments of filler material to correspond with the quantities required and discussed in connection with FIGS. 2 and 3. With the suitable lengths of these cable components, these components are closed and passed through a pre-twister 38, to be more fully discussed below. From the pre-twister, the cable is passed through a double twist machine 42 in which the components experience two twists to produce the cable shown in FIG. 1. The cable coming out of the double twist machine is then suitably jacketed or covered in any known or conventional way, such as by an extruder.

It will be appreciated that the cable components, including the insulated conductors and the filaments of filler materials, are guided throughout the line by suitable elements well known to those skilled in the art. Generally, suitable guiding elements, to be described in connection with FIGS. 5 and 6, guide the individual filaments or components of the cable from the region of the payoff stations 32, 34 to the point at which the components are closed or brought into contact with each other into a twisted arrangement.

The double twist machine 42 is, as shown, positioned downstream of the point at which the cable components are closed upon each other and helically twists the plurality of insulated conductors and filaments of filler material into a cable formed of the twisted helical conductors. The cable so formed defines the axis $A_0$ as well as the radially outwardly facing helical interstices 24, each of which is substantially filled with another of the filaments of filler material 26.

Generally, the length metering device is a differential or incremental length metering device arranged between the payoff stations 32, 34 and the double twist machine 42 for paying off an incremental length of filler materials relative to the length of the insulated conductors to substantial compensate for the differences in the radial distances $R_f$ and $R_c$ of the insulated conductors and filaments and filler material from the cable axis. In this way, the helical interstices are more fully filled and the resulting cable has an exterior surface with minimal voids 28 so that covering of the resulting cable within an outer elastomeric jacket or coating $C_j$ results in a substantially smoother and aesthetically pleasing cable with minimum surface irregularities.

Figure 5:
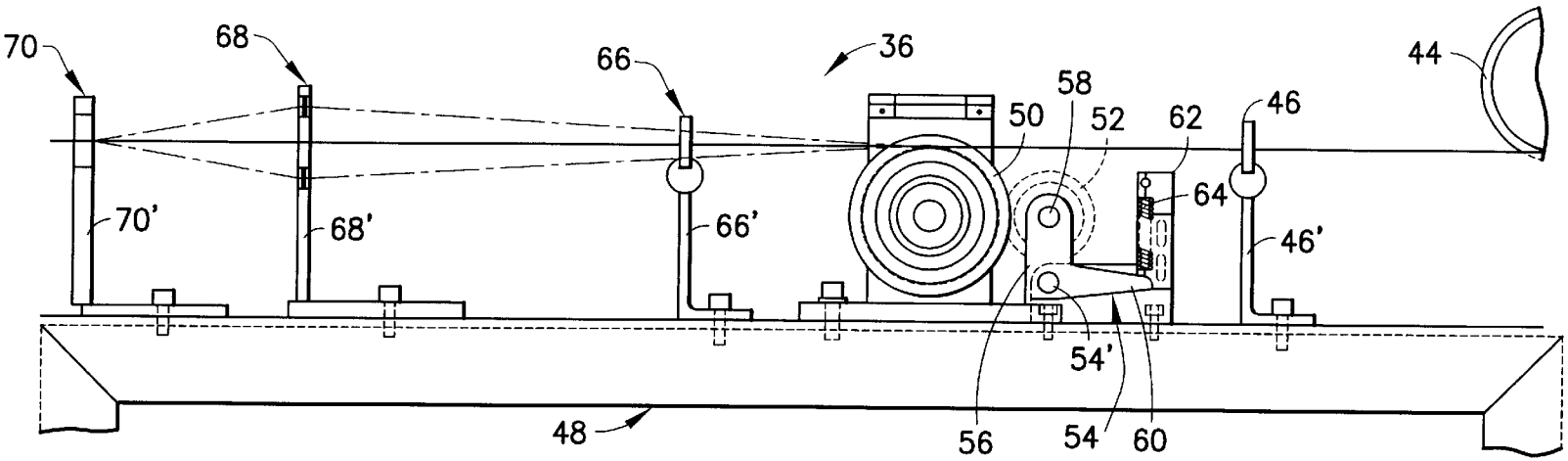
FIG. 5 is an enlarged side elevational view of the length metering wheel in accordance with the present invention used in the apparatus or line shown in FIG. 4.
Figure 6:
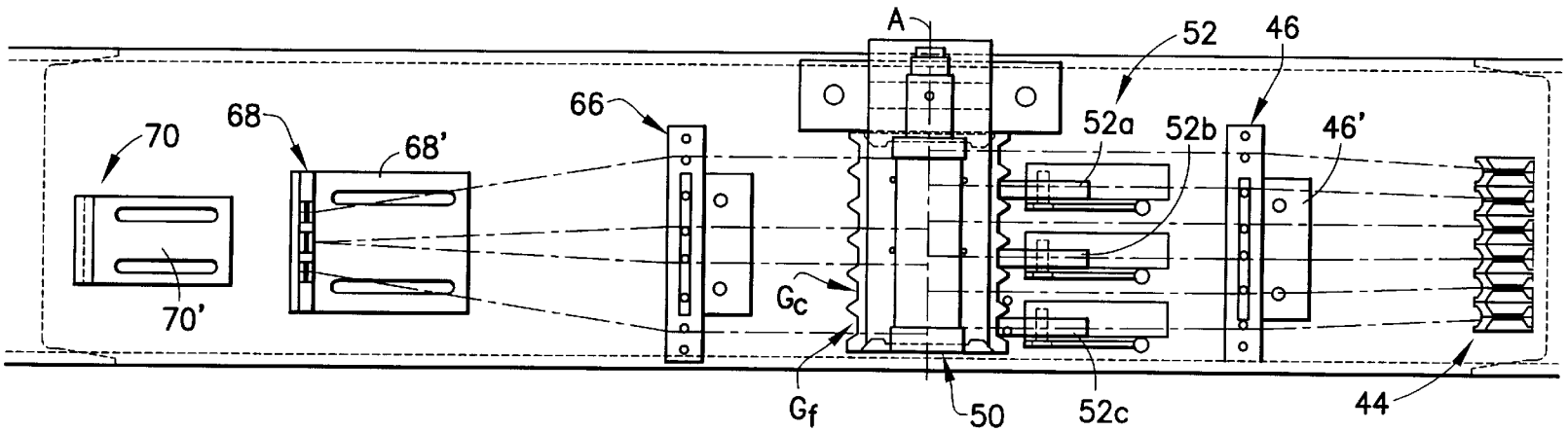
FIG. 6 is a top elevational view of the length metering wheel shown in FIG. 5.

Referring to FIGS. 5 and 6, a guide roller 44 is shown forming part of the guide mechanism for the individual cable components as these approach the length metering device 36. Mounted between the guide roller 44 and the length metering device 36 is a separator 46 mounted on a bracket 46' secured to a table or support platform 48 for separating the cable components, namely, the insulated conductors and the filaments of filler material and maintain them separated or spaced from each other when in proximity to the length metering device 36.

Figure 7:
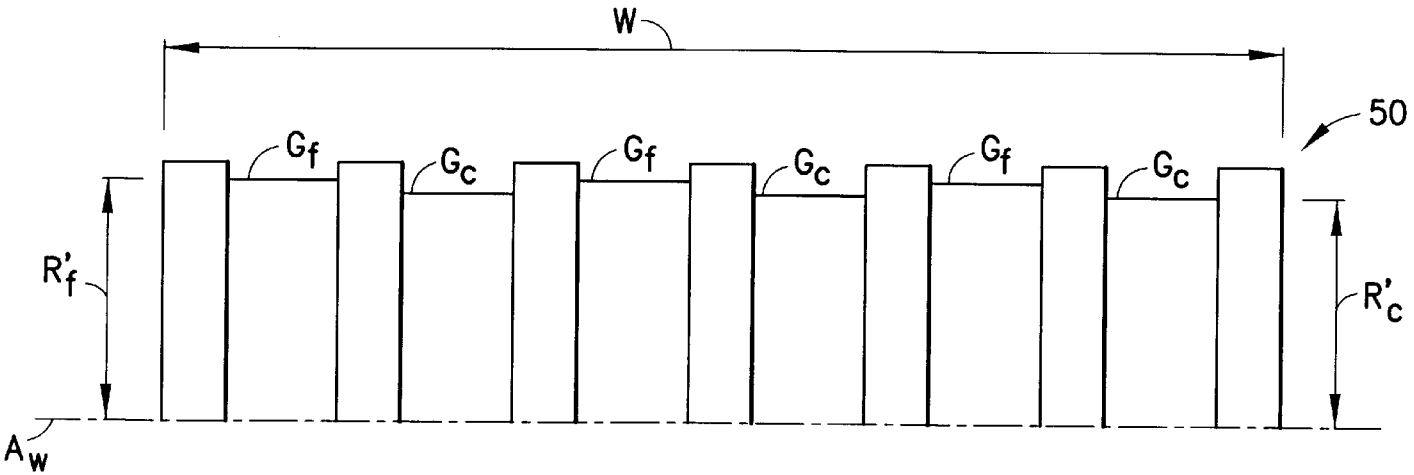
FIG. 7 is an enlarged front elevational view of the length metering wheel shown in FIGS. 5 and 6 to show the two sets of successively arranged grooves for respectively receiving insulated conductors and filaments of filler material in grooves of different diameters to provide the differential or incremental length metering in accordance with the invention.

In accordance with the presently preferred embodiment of the invention, the length metering device 36 is in the form of a cylindrical wheel 50 mounted for rotation about an axis $A_w$ (FIG. 7) generally normal to the line direction of the apparatus and defines a cylindrical outer surface formed with a plurality of annular grooves spaced along the axis of rotation along its width W. Such annular grooves, referring to FIGS. 6 and 7, are formed as two sets of alternating grooves, each defining another predetermined inner radius. In FIG. 7, one set of grooves, $G_c$, receives the insulated conductors and has radii smaller than the radii of the other set of grooves, $G_f$, for receiving the filaments of said filler material. In this way, wrapping of the insulated conductors at least one 360° turn about the grooves causes a predetermined amount of material to be gripped and advanced along the line.

As it is desirable to maintain each cable component, whether insulated conductor or filament of filler material, within the appropriate groove of the metering wheel 50, separator 46 guides each of the components to an appropriate groove. Preferably, a second separator 66 is provided downstream of the length metering wheel 50 to thereby maintain the cable components in substantially parallel orientations as they pass through their associated or respective grooves, as best shown in FIG. 6.

The annular grooves $G_f$ and $G_c$ are formed as two sets of alternating grooves each set defining another radius as indicated, and also serve as a positioning member for maintaining the relative positions of the cable components in positions to facilitate their twisting into the desired cable configuration. By wrapping the insulated conductors by at least one turn, as suggested in FIG. 5, about their associated grooves of the metering wheel 50 and wrapping the filaments of filler material about their associated grooves about the same metering wheel, it will be clear that rotation of the metering wheel 50 will incrementally meter slightly greater lengths of filaments of the filler material as compared with the lengths of the insulated conductor with rotation of the wheel. When the radius of the grooves of one set for insulated conductors is $R_c'$ and the radius of the grooves of the other set for the filaments of filler material is $R_f'$, the ratio of such radii is selected by computing ($R_f'/R_c'=C_f/C_c$), where $C_f/C_c$ is the desired incremental length of filaments of filler material to be metered as compared to the length of the insulated conductors. In accordance with the presently preferred invention, $C_f/C_c$ is approximately equal to 1.02 ($C_f/C_c \approx 1.02$).

The tension on the insulated conductors and the filaments of filler material, when wrapped at least once about the metering wheel 50 generally provides sufficient friction between the wheel and the cable components to draw these from their respective payoff stations. However, suitable friction enhancement devices may be used to ensure that there is no slippage between the cable components and the exterior surfaces within the grooves. Any friction enhancing means may be used, such as a tacky material applied to the exterior surfaces of the grooves or friction enhancing circular sleeves may be secured to the insides of the grooves to increase friction, such as rubber or rubberized bands that are undersized and stretched over the metering wheel to contact and frictionally engage the inner surfaces of the grooves. A single rotatably mounted pressure roller may be used, which is biased against the cylindrical wheel by any known or suitable means to apply a pressure to the insulated conductors and/or filaments of filler material positioned between the cylindrical wheel and such pressure roller to thereby provide reliable metering with rotation of the cylindrical wheel. In the presently preferred embodiment, a plurality, namely, three, pressure rollers 52*a*–52*c* are each shown to be rotatably mounted about shafts, axles or pins 58 oriented in a direction generally parallel to the axis of rotation of the metering wheel 50 and mounted on pivotally mounted brackets or cranks 54 each having a first substantially vertical portion 56 and a substantially horizontal portion 60. Each pressure roller is rotatably mounted at the free end of an associated portion 56, while the free end of each portion 60 is secured to a tension spring 62 which is fixed at its other end on a bracket 62. It will be evident, therefore, that when each crank 54 is pivotally mounted as shown about a pivot pin 54', the crank 54 will be biased to pivot in a generally counterclockwise direction to thereby urge the associated pressure roller 52 against the metering wheel 50. The pressure rollers are used, as best shown in FIG. 6, as least with respect to those grooves about which the filaments of filler material are wrapped as these generally experience smaller frictional forces when wrapped about the wheel. Pressure rollers are not generally required to be used in conjunction with those grooves about which the insulated conductors are wrapped, as the insulations themselves provide sufficient friction when engaged with the exterior surfaces of the grooves. However, when single pressure roller is used, it preferably has a complementary profile to the grooves of the metering wheel 50 so that portions of the pressure roller can extend into and abut against associated portions of the metering wheel 50 grooves.

Downstream of the separator 66 there is provided a lay plate 68 mounted on a bracket 68' which serves to arrange the cable components from substantially a single plane as existing between the separators 46, 66 into a generally circular configuration more closely approaching the final configuration when closed immediately downstream at the closing die 70 mounted on bracket 70'. Once the cable components are closed at 70, the further processing of the cable is substantially similar as disclosed in the aforementioned U.S. Pat. No. 4,574,571, namely, the closed cable is extended through a pre-twister 38 after which the cable may optionally extend through a cable clamp 40 which temporarily secures and prevents the assembled cable from "breaking up" when power to the line is shut off.

The pre-twister 38 preferably twists the cable components at approximately twice the speed of the speed of the bow of the double twist machine 42. If desired, the pre-twister may be made to be adjustable in speed as in the aforementioned patent. It has been found that, while not absolutely essentially, the pre-twister 38 does somewhat improve the quality of the finished cable by pre-twisting the filaments of filler material and causes same to become better seated within the helical interstices. This results from the change of the pitch or lay of the cable, causing the filler to be positioned radially outwardly or higher up away from the center of the cable.

In view of the foregoing, it is clear that when filler material in composite cables of the type under discussion has a tensile strength less than the tensile strength of the insulated conductors, so that the filaments can stretch and be deformed, such a stretching will take place when equal lengths of insulated conductors and filaments of filler materials are metered to the twisting equipment by virtue of the relative positioning of these components with respect to the center of the cable. With the present invention, however, notwithstanding that the filaments of filler material are spaced radially further out from the center of the cable than are the insulated conductors, the provision of a separate capstan, in the form of a length metering wheel provided with annular grooves of different diameters, provides that incremental or differential lengths of component materials may be metered to compensate for the differences in positions of these components within the cable and, therefore, to compensate for the differences in the sizes of the helices that these components form within the assembled cable.

By producing a cable that is closer to the ideal geometrical configuration shown in FIG. 1, a suitable PVC or other jacket or covering sheath can be applied to the twisted conductors, in a conventional manner, to produce a higher quality, more aesthetically pleasing product. However, by enabling such product to be made with a double twist machine, production efficiencies are substantially improved and the product can be produced at substantially lower cost than has heretofore been done on single twist equipment.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What I claim:

1. Apparatus for manufacturing helically wound insulated conductors with fillers comprising:

(a) first payoff means for paying off a plurality of elongate insulated conductors;

(b) second payoff means for paying off a plurality of elongate filaments of filler materials;

(c) closing means for closing said insulated conductor and filaments of filler material downstream from said payoff means;

(d) guide means for guiding said insulated conductors and filaments of filler material from said payoff means to said closing means and for arranging said insulated conductors and filaments of filler material in positions for twisting into a cable;

(e) a double twist machine downstream of said closing means for helically twisting said plurality of insulated conductors and filaments of filler material into a cable formed of said twisted helical conductors and defining an axis and radially outwardly facing helical interstices each substantially filled with another one of said filaments of filler material; and (f) differential length metering means arranged between said payoff means and said double twist machine for paying off an incrementally greater length of filler materials relative to the length of insulated conductor to substantially compensate for the differences in the radial distances of said insulated conductors and filaments of filler material from said cable axis, whereby said helical interstices are more fully filled and the resulting cable has an exterior surface with minimal voids so that covering of the resulting cable with an outer elastomeric jacket or coating results in a substantially smoother and aesthetically pleasing cable with minimal surface irregularities.

2. Apparatus as defined in claim 1, wherein said closing means comprises a closing die.

3. Apparatus as defined in claim 1, wherein said guide means includes separating means for maintaining said insulated conductors and said filaments of filler material separated from each other at least when in contact with said differential length metering means.

4. Apparatus as defined in claim 3, wherein the apparatus defines a line direction along which said insulated conductors and filaments of filler material are removed from said payoff means to said double twist machine, and said separating means comprises at least one separator mounted in general proximity to said differential length metering means for maintaining said insulated conductors and filaments of filler materials along orientations generally parallel to said line direction at least in the region of said differential length metering means.

5. Apparatus as defined in claim 4, wherein said differential length metering means comprises a cylindrical wheel mounted for rotation about an axis generally normal to said line direction and having a cylindrical outer surface formed with annular grooves spaced along said axis, said separators being formed and arranged to substantially fix the positions of said insulated conductors and said filaments of filler materials adjacent to said differential length metering means to substantially correspond to said spacing of said annular grooves to maintain same in said grooves.

6. Apparatus as defined in claim 1, wherein the apparatus defines a line direction along which said insulated conductors and said filaments of filler material are moved from said payoff means to said double twist machine, and said differential length metering means comprises a cylindrical wheel mounted for rotation about an axis generally normal to said line direction and having a cylindrical outer surface formed with annular grooves spaced along said axis.

7. Apparatus as defined in claim 6, wherein said annular grooves are formed as two sets of alternating grooves, each set defining another inner radius.

8. Apparatus as defined in claim 7, wherein one set of grooves is for receiving said insulated conductors and has radii smaller than the radii of the other set of grooves for receiving said filaments of filler material, whereby wrapping said insulated conductors at least one turn about said grooves of said one set causes an incrementally smaller length of insulated conductors to be metered when said cylindrical wheel is rotated than the length of filler material when the latter are wrapped said at least one turn about said grooves of said other set.

9. Apparatus as defined in claim 8, wherein the radius of said grooves of said one set is $r_c$ and the radius of said grooves of said other set is $r_f$, the ratio of such radii being selected by computing $$r_f/r_c=c_f/c_c,$$

where $c_f/c_c$ is the desired incremental length of filaments of filler material to be metered as compared to the length of said insulated conductors.

10. Apparatus as defined in claim 9, wherein $c_f/c_c \approx 1.02$.

11. Apparatus as defined in claim 1, wherein said differential length metering means comprises a cylindrical wheel about which said insulated conductors and said filaments of filler materials are wrapped, said exterior surface of said cylindrical wheel providing frictional engagement to provide desired metering with rotation of said cylindrical wheel.

12. Apparatus as defined in claim 11, further comprising friction enhancing means for ensuring adequate friction between said cylindrical wheel and said insulated conductors and filaments of filler material.

13. Apparatus as defined in claim 12, wherein said friction enhancing means comprises a rotatably mounted pressure roller biased against said cylindrical wheel, whereby insulated conductors and filaments of filler materials positioned between said cylindrical wheel and said pressure roller are reliably metered with rotation of said cylindrical wheel.

14. Apparatus as defined in claim 4, wherein two separators are provided, one upstream and one downstream of said differential length metering means.

15. Apparatus as defined in claim 14, wherein said upstream separator is positioned between said payoff means and said differential length metering means.

16. Apparatus as defined in claim 14, wherein said guide means includes a lay plate downstream of said differential metering means and said downstream separator is positioned between said differential metering means and said lay plate.

17. Apparatus as defined in claim 16, further comprising a closing die between said lay plate and said double twist machine.

18. A method for manufacturing helically wound insulated conductors with fillers comprising:

(a) first payoff means for paying off a plurality of elongate insulated conductors;

(b) second payoff means for paying off a plurality of elongate filaments of filler materials having a tensile strength lower than the tensile strength of said insulated conductors;

(c) closing means for closing said insulated conductor and filaments of filler material downstream from said payoff means;

(d) guide means for guiding said insulated conductors and filaments of filler material from said payoff means to said closing means and for arranging said insulated conductors and filaments of filler material in positions for twisting into a cable;

(e) a double twist machine downstream of said closing means for helically twisting said plurality of insulated conductors and filaments of filler material into a cable formed of said twisted helical conductors and defining an axis and radially outwardly facing helical interstices each substantially filled with another one of said filaments of filler material; and (f) differential length metering means arranged between said payoff means and said double twist machine for paying off an incrementally greater length of filler materials relative to the length of insulated conductor to substantially compensate for the differences in the radial distances of said insulated conductors and filaments of filler material from said cable axis, whereby said helical interstices are more fully filled and the resulting cable has an exterior surface with minimal voids so that covering of the resulting cable with an outer elastomeric jacket or coating results in a substantially smoother and aesthetically pleasing cable with minimal surface irregularities.

* * * * *